US010159865B2

(12) United States Patent
Adams

(10) Patent No.: US 10,159,865 B2
(45) Date of Patent: Dec. 25, 2018

(54) TRAMPOLINE SYSTEMS AND METHODS OF MAKING AND USING THE SAME

(71) Applicant: Arch Luther Adams, Hartwell, GA (US)

(72) Inventor: Arch Luther Adams, Hartwell, GA (US)

(73) Assignee: PROJECT COLUMBUS ACQUISITION, LLC, Hartwell, GA (US)

( * ) Notice: Subject to any disclaimer, the term of this patent is extended or adjusted under 35 U.S.C. 154(b) by 17 days.

(21) Appl. No.: 15/640,982

(22) Filed: Jul. 3, 2017

(65) Prior Publication Data

US 2018/0001125 A1 Jan. 4, 2018

Related U.S. Application Data

(60) Provisional application No. 62/357,908, filed on Jul. 1, 2016.

(51) Int. Cl.

| | |
|---|---|
| ***A63B 5/11*** | (2006.01) |
| ***A63B 71/02*** | (2006.01) |
| ***A63G 31/00*** | (2006.01) |
| ***A63B 5/02*** | (2006.01) |
| ***A63B 17/00*** | (2006.01) |
| *A63B 71/00* | (2006.01) |

(52) U.S. Cl.

CPC ..... *A63B 5/11* (2013.01); *A63B 5/02* (2013.01); *A63B 17/00* (2013.01); *A63B 71/023* (2013.01); *A63G 31/00* (2013.01); *A63B 71/022* (2013.01); *A63B 2071/009* (2013.01); *A63B 2071/0063* (2013.01); *A63B 2071/0081* (2013.01); *A63B 2220/24* (2013.01); *A63B 2220/51* (2013.01); *A63B 2220/54* (2013.01); *A63B 2225/62* (2013.01)

(58) Field of Classification Search

CPC ..... A63B 5/11

See application file for complete search history.

(56) References Cited

U.S. PATENT DOCUMENTS 4,077,623 A * 3/1978 Clausell ..... A63B 5/11 482/24

2006/0223676 A1 10/2006 Rote

2013/0252787 A1 9/2013 Howell

FOREIGN PATENT DOCUMENTS

DE 8903049 6/1989

* cited by examiner

*Primary Examiner* — Loan H Thanh

*Assistant Examiner* — Rae Fischer

(74) *Attorney, Agent, or Firm* — Withers & Keys, LLC

(57) ABSTRACT

Trampoline systems containing multiple trampoline jumping surfaces are disclosed. Methods of making and using trampoline systems containing multiple trampoline jumping surfaces are also disclosed.

14 Claims, 8 Drawing Sheets

TRAMPOLINE SYSTEMS AND METHODS OF MAKING AND USING THE SAME

CROSS-REFERENCE TO RELATED APPLICATIONS

This patent application claims the benefit of priority to U.S. Provisional Patent Application Ser. No. 62/357,908 filed on Jul. 1, 2016 and entitled "TRAMPOLINE SYSTEMS AND METHODS OF MAKING AND USING THE SAME", the subject matter of which is hereby incorporated by reference in its entirety.

FIELD OF THE INVENTION

The present invention is directed to trampoline systems. The present invention is further directed to methods of making and using trampoline systems.

BACKGROUND

Efforts continue to further develop trampoline systems.

SUMMARY

The present invention addresses some of the difficulties and problems discussed above by the discovery of new trampoline systems.

Accordingly, the present invention is directed to trampoline systems. In one exemplary embodiment, the trampoline systems of the present invention comprise: four or more trampoline jumping surfaces with each trampoline jumping surface (a) extending between a central axis of the trampoline system and an outer edge of the trampoline system, the outer edge completely surrounding the central axis, and (b) comprising opposite side surface edges extending along opposite lines, each of the opposite lines extending through the central axis and forming an angle A therebetween, wherein each of angle A is equal to or less than about 90°.

In another exemplary embodiment, the trampoline systems of the present invention comprise a trampoline system comprising: (I) four or more trampoline jumping surfaces with each trampoline jumping surface (a) extending between a central axis of the trampoline system and an outer edge of the trampoline system, the outer edge completely surrounding the central axis, and (b) comprising opposite side surface edges extending along opposite lines, each of the opposite lines extending through the central axis and forming an angle A therebetween, wherein each of angle A is equal to or less than about 90°; and (II) a rotating member rotatable along the central axis, the rotating member comprising a vertically-extending member, and at least one horizontally-extending arm extending outward from the vertically-extending member towards the outer edge.

The present invention is further related to methods of making trampoline systems. In one exemplary embodiment, the method of making a trampoline system comprises: assembling four or more trampoline jumping surfaces with one another so that each trampoline jumping surface (a) extends between a central axis of the trampoline system and an outer edge of the trampoline system, the outer edge completely surrounding the central axis, and (b) comprises opposite side surface edges extending along opposite lines, each of the opposite lines extending through the central axis and forming an angle A therebetween, wherein each angle A is equal to or less than about 90°.

The present invention is even further related to methods of using trampoline systems. In one exemplary embodiment, the method of using a trampoline system comprises: jumping on at least one of four or more trampoline jumping surfaces with each trampoline jumping surface (a) extending between a central axis of the trampoline system and an outer edge of the trampoline system, the outer edge completely surrounding the central axis, and (b) comprising opposite side surface edges extending along opposite lines, each of the opposite lines extending through the central axis and forming an angle A therebetween, wherein each of angle A is equal to or less than about 90°. In some embodiments, the method of using trampoline systems further comprises: trying to avoid contact with at least one horizontally-extending arms of a rotating member rotating along the central axis.

These and other features and advantages of the present invention will become apparent after a review of the following detailed description of the disclosed embodiments and the appended claims.

DETAILED DESCRIPTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to trampoline systems. The present invention is further directed to methods of making trampoline systems. The present invention is even further directed to methods of using trampoline systems.

The trampoline systems of the present invention are further described in the following embodiments and claims.

See also, the figures.

Other Embodiments:

Trampoline Systems

Figure 5:
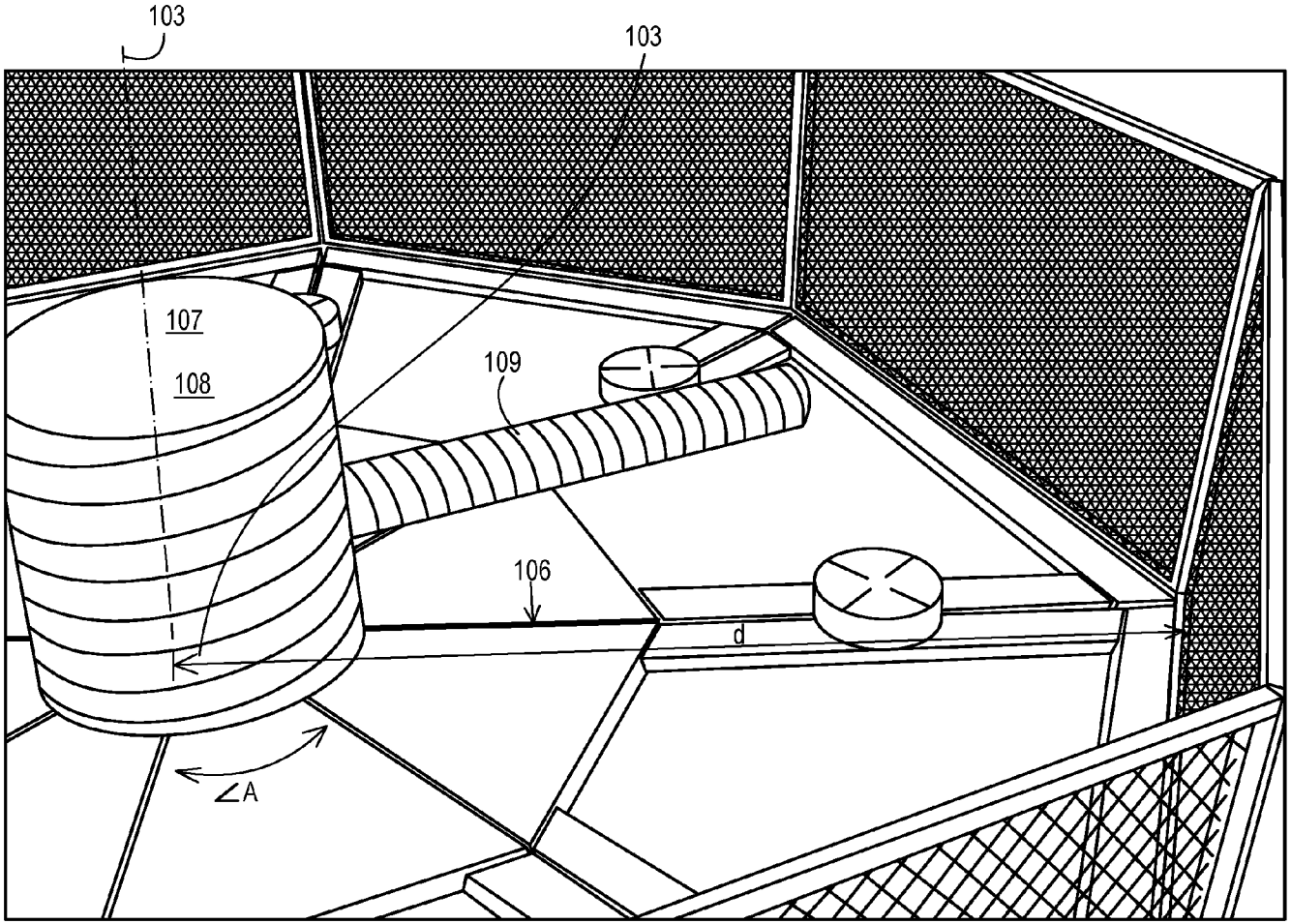
FIG. 5 is yet another closer perspective top view of the exemplary trampoline system shown in FIG. 2.

1. A trampoline system 100 comprising: four or more trampoline jumping surfaces 101 with each trampoline jumping surface 101 (*a*) extending between a central axis 103 of said trampoline system 100 and an outer edge 104 of said trampoline system 100, said outer edge 104 completely surrounding said central axis 103, and (b) comprising opposite side surface edges 102 extending along opposite lines 105, each of said opposite lines 105 extending through said central axis 103 and forming an angle A therebetween, wherein each of said angle A is equal to or less than about 90°. It should be noted that trampoline systems of the present invention may comprise as few as two or three trampoline jumping surfaces 101 with each trampoline jumping surface 101 (a) extending between a central axis 103 of said trampoline system 100 and an outer edge 104 of said trampoline system 100, said outer edge 104 completely surrounding said central axis 103, and (b) comprising opposite side surface edges 102 extending along opposite lines 105, as discussed above; however, typically, trampoline systems of the present invention, such as exemplary trampoline system 100, comprise four or more trampoline jumping surfaces 101 as discussed herein.
2. The trampoline system 100 of embodiment 1, wherein each of said angle A is equal to or less than about 80°.
3. The trampoline system 100 of embodiment 1 or 2, wherein each of said angle A is equal to or less than about 72°.
4. The trampoline system 100 of any one of embodiments 1 to 3, wherein said trampoline system 100 comprises five or more trampoline jumping surfaces 101 and five or more independent angles A, and each of said five or more independent angles A is equal to or less than about 72°.
5. The trampoline system 100 of any one of embodiments 1 to 4, wherein said trampoline system 100 comprises six or more trampoline jumping surfaces 101 and six or more independent angles A, and each of said six or more independent angles A is equal to or less than about 60°.
6. The trampoline system 100 of any one of embodiments 1 to 5, wherein said trampoline system 100 comprises seven or more trampoline jumping surfaces 101 and seven or more independent angles A, and each of said seven or more independent angles A is equal to or less than about 51.4°.
7. The trampoline system 100 of any one of embodiments 1 to 6, wherein said trampoline system 100 comprises eight or more trampoline jumping surfaces 101 and eight or more independent angles A, and each of said eight or more independent angles A is equal to or less than about 45°.
8. The trampoline system 100 of any one of embodiments 1 to 7, wherein said trampoline system 100 comprises n trampoline jumping surfaces 101 and n independent angles A, and each of said n independent angles A is equal to or less than about (360°/n).
9. The trampoline system 100 of any one of embodiments 1 to 8, wherein each trampoline jumping surface 101 independently has a triangular shape or an isosceles trapezoid shape.
10. The trampoline system 100 of any one of embodiments 1 to 9, wherein at least one of said trampoline jumping surface 101 has a triangular shape.
11. The trampoline system 100 of any one of embodiments 1 to 10, wherein each trampoline jumping surface 101 has a triangular shape.
12. The trampoline system 100 of any one of embodiments 1 to 11, wherein each of said opposite lines 105 extends greater than 90% of a distance d between said central axis 103 and said outer edge 104. See, d in FIG. 5.
13. The trampoline system 100 of any one of embodiments 1 to 12, wherein each of said opposite lines 105 extends substantially a distance d between said central axis 103 and said outer edge 104. See, d in FIG. 5.
14. The trampoline system 100 of any one of embodiments 1 to 10, wherein at least one of said trampoline jumping surface 101 has an isosceles trapezoid shape.
15. The trampoline system 100 of any one of embodiments 1 to 9 and 14, wherein each of said trampoline jumping surface 101 has an isosceles trapezoid shape.
16. The trampoline system 100 of any one of embodiments 1 to 9 and 14 to 15, wherein each of said opposite lines 105 extends less than about 90% of a distance d between said central axis 103 and said outer edge 104. For example, each of said opposite lines 105 may extend from point 106 to outer edge 104 shown in FIG. 5.
17. The trampoline system 100 of any one of embodiments 1 to 9 and 14 to 16, wherein each of said opposite lines 105 extends from about 50% to about 80% of a distance d between said central axis 103 and said outer edge 104.
18. The trampoline system 100 of any one of embodiments 1 to 17, wherein at least a portion of each of said trampoline jumping surfaces 101 is within a plane (i.e., a plane that is normal (i.e., at a 90° angle) to said central axis 103).
19. The trampoline system 100 of any one of embodiments 1 to 18, wherein an inner edge 119 of each of said trampoline jumping surfaces 101 is substantially within a plane, said inner edge 119 being closest to said central axis 103.
20. The trampoline system 100 of any one of embodiments 1 to 19, wherein said outer edge 104 of said trampoline system 100 is substantially within a plane.
21. The trampoline system 100 of any one of embodiments 1 to 20, wherein substantially all of said trampoline jumping surfaces 101 are within a plane.
22. The trampoline system 100 of any one of embodiments 1 to 21, further comprising: a rotating member 107 rotatable along said central axis 103, said rotating member 107 comprising a vertically-extending member 108, and at least one horizontally-extending arm 109 extending outward from said vertically-extending member 108 towards said outer edge 104. See, for example, exemplary rotating member 107 shown in FIGS. 1-5. It should be noted that although vertically-extending member 108 is shown as having a circular cross-sectional shape, vertically-extending member 108 can have any desired cross-sectional shape including, but not limited to, a triangular shape, a rectangular shape, a square shape, a star shape, a pentagonal shape, a hexagonal shape, etc. Likewise, it should be noted that although each horizontally-extending arm 109 is shown as having a circular cross-sectional shape, each horizontally-extending arm 109 can independently have any desired cross-sectional shape including, but not limited to, a triangular shape, a rectangular shape, a square shape, a star shape, a pentagonal shape, a hexagonal shape, etc.
23. The trampoline system 100 of embodiment 22, wherein each of said at least one horizontally-extending arm 109 extends less than about 90% of a distance d between said central axis 103 and said outer edge 104. For example, each of said at least one horizontally-extending arm 109 may extend from central axis 103 to point 110 shown in FIG. 2.

Figure 7:
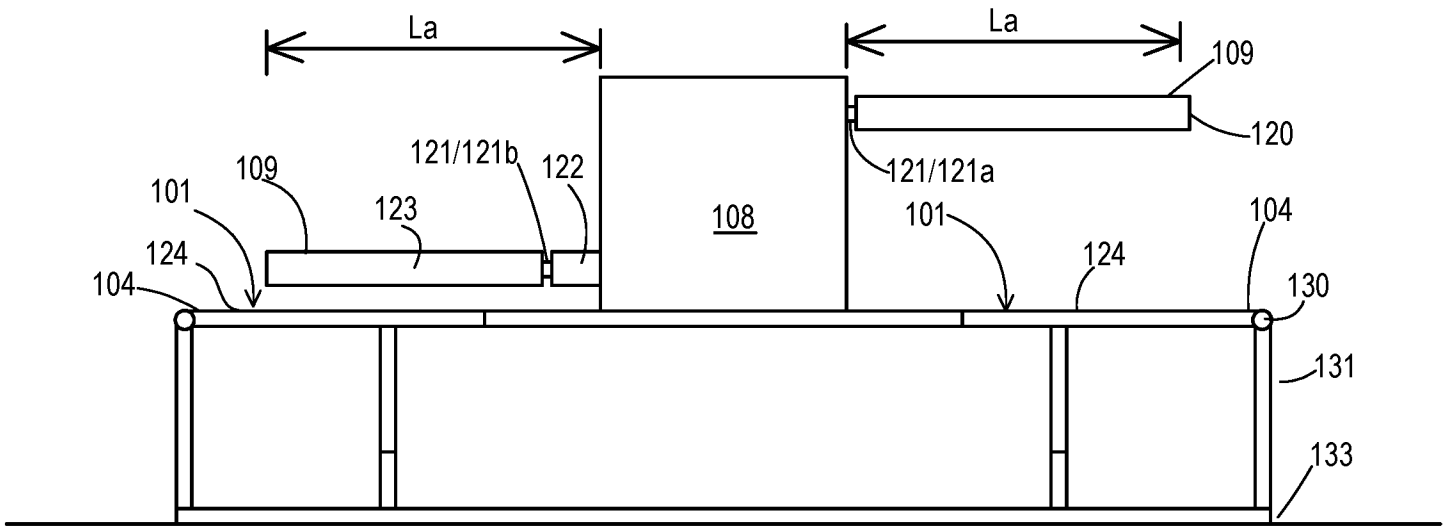
FIG. 7 is a side view of an exemplary trampoline system of the present invention in which one or more joints are present along horizontally-extending arms of a rotating member rotating along the central axis of the exemplary trampoline system.
Figure 8:
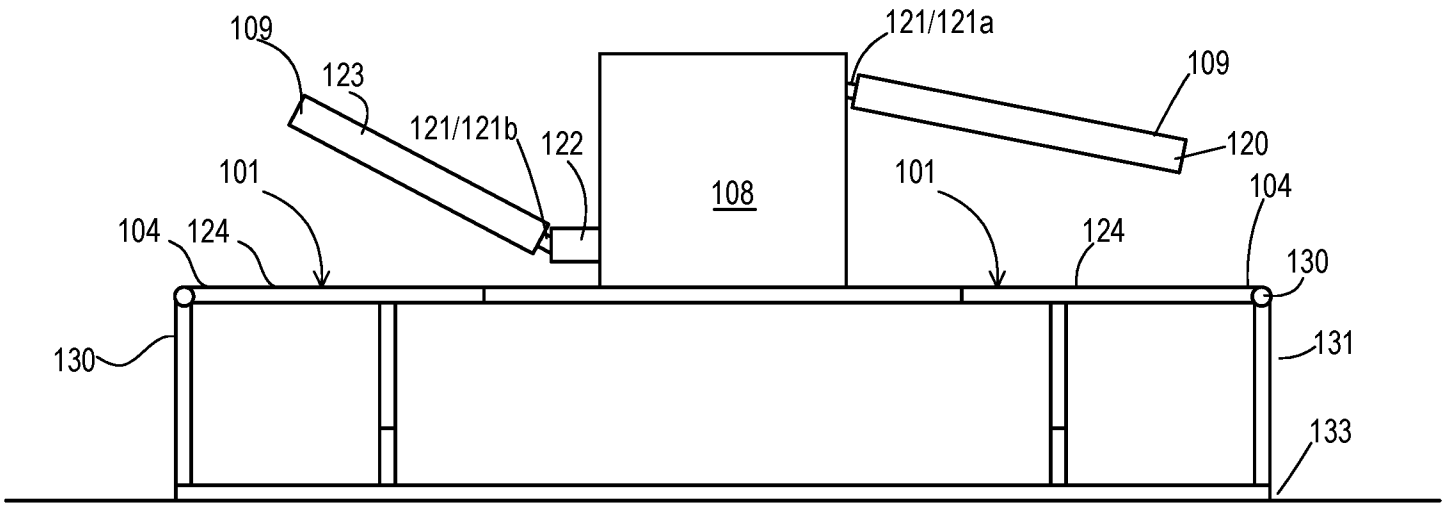
FIG. 8 is a side view of the exemplary trampoline system shown in FIG. 7 with the horizontally-extending arms bend at the one or more joints.

24. The trampoline system 100 of embodiment 22 or 23, wherein said rotating member 107 comprises two horizontally-extending arms 109 positioned on opposite sides of said vertically-extending member 108. In other embodiments, rotating member 107 of trampoline system 100 may comprise three or four (or five or six or seven or eight) horizontally-extending arms 109 positioned along said vertically-extending member 108 at three or four (or five or six or seven or eight) independent (i.e., different and/or same) positions and independent (i.e., different and/or same) heights along vertically-extending member 108.
25. The trampoline system 100 of any one of embodiments 22 to 24, wherein each of said at least one horizontally-extending arm 109 independently rotates a distance h or greater above said four or more trampoline jumping surfaces 101. See, for example, exemplary distance h shown in FIG. 4.
26. The trampoline system 100 of embodiment 24 or 25, wherein said two horizontally-extending arms 109 rotate (i) a distance h and (ii) a distance (h+h2), respectively, above said four or more trampoline jumping surfaces 101. See, for example, exemplary distances h and (h+h2) shown in FIG. 4. It should be understood that each horizontally-extending arm 109 can rotate at a distance independent of any other horizontally-extending arm 109. For example, in some embodiments, all of the one or more horizontally-extending arms 109 (e.g., from 2 to 8 horizontally-extending arms 109) can rotate at the same height h. In other embodiments, each of the one or more horizontally-extending arms 109 (e.g., from 2 to 8 horizontally-extending arms 109) can rotate at the same height (e.g., h) or at two or more different heights, for example, at height h, height (h+h2), height (h+h3) where h3 is greater than or less than h2, etc. In one desired embodiment, three horizontally-extending arms 109 are present and rotate at two or three different heights, for example, at height h, height (h+h2), and height (h+h3) where h3 is greater than or less than h2, at three different locations along vertically-extending member 108.
27. The trampoline system 100 of any one of embodiments 22 to 26, wherein at least a portion of said rotating member 107 is inflatable.
28. The trampoline system 100 of any one of embodiments 22 to 27, wherein at least a portion of said rotating member 107 comprises foam padding 111.
29. The trampoline system 100 of any one of embodiments 22 to 28, wherein said rotating member 107 rotates about central axis 103 at a frequency of up to about 60 rotations per minute (rpm) (or any number of rotations between 1 and 60 rpm, in increments of 0.1 rpm, e.g., 6.2 rpm, or any range of rotations between 1 and 60 rpm, in increments of 0.1 rpm, e.g., from about 6.2 to about 6.8 rpm).
30. The trampoline system 100 of any one of embodiments 22 to 29, wherein said rotating member 107 rotates about central axis 103 at a frequency of from about 3 to about 30 rotations per minute (rpm).
31. The trampoline system 100 of any one of embodiments 22 to 30, wherein at least a portion of said at least one horizontally-extending arm 109 is inflatable.
32. The trampoline system 100 of any one of embodiments 22 to 31, wherein at least a portion of said at least one horizontally-extending arm 109 comprises foam padding 111.
33. The trampoline system 100 of any one of embodiments 22 to 32, wherein each of said at least one horizontally-extending arm 109 comprises an arm construction that allows said at least one horizontally-extending arm 109 to bend (i) upward, (ii) downward, (iii) sideways, or (iv) any combination of (i) upward, (ii) downward, and (iii) sideways, when a force is applied onto said at least one horizontally-extending arm 109. As an added safety feature, rotating member 107 may further comprise electronics and/or sensors (not shown) that stop rotation of rotating member 107 when at least one occurrence takes place, such as (1) when a given horizontally-extending arm 109 bends beyond a threshold amount (e.g., more than a 10° angle from its unbend position), and/or (2) when a threshold amount of resistance force is applied to horizontally-extending arm 109 or rotating member 107 or vertically-extending member 108 in a direction opposite the rotation direction of rotating member 107.
34. The trampoline system 100 of embodiment 33, wherein each of said at least one horizontally-extending arm 109 comprises a flexible material construction along a length $L_a$ of said at least one horizontally-extending arm 109. Suitable flexible materials include, but are not limited to, plastic materials, polymeric materials, foam materials, inflatable materials, metal materials (e.g., a metal spring extending length $L_a$ or a portion of length $L_a$), or any combination thereof.
35. The trampoline system 100 of embodiment 34, wherein the flexible material construction extends along less than a complete length $L_a$ of said at least one horizontally-extending arm 109. For example, a given horizontally-extending arm 109 may have (i) a relatively rigid (i.e., not bendable) from said vertically-extending member 108 to a location along the length $L_a$ of the horizontally-extending arm 109, such as to the location along the length $L_a$ of the horizontally-extending arm 109 directly above an inner edge 119 of each of said trampoline jumping surfaces 101, and (ii) a flexible material construction from the location to the end 120 of the horizontally-extending arm 109.
36. The trampoline system 100 of embodiment 34, wherein the flexible material construction extends along a complete length $L_a$ of said at least one horizontally-extending arm 109.
37. The trampoline system 100 of embodiment 33, wherein each of said at least one horizontally-extending arm 109 comprises a rigid material construction along a length $L_a$ of said at least one horizontally-extending arm 109 with one or more joints 121 positioned along the length $L_a$ of said at least one horizontally-extending arm 109. Suitable rigid materials include, but are not limited to, plastic materials, polymeric materials, foam materials, metal materials, or any combination thereof. Exemplary joints 121 are shown in FIGS. 7-8. As shown, each joint 121 may be present (i) between a given horizontally-extending arm 109 and vertically-extending member 108, such as exemplary joint 121*a*, or (ii) between proximate and distal sections, 122/123 respectively, of a given horizontally-extending arm 109, such as exemplary joint 121*b*. A given joint 121 may comprise one or more flexible materials and/or springs (not shown) that enables (i) upward, (ii) downward, (iii) sideways, or (iv) any combination of (i) upward, (ii) downward, and (iii) sideways, bending at joint 121 when a force is applied onto said at least one horizontally-extending arm 109. See, for example, bent joints 121 shown in FIG. 8.

Figure 1:
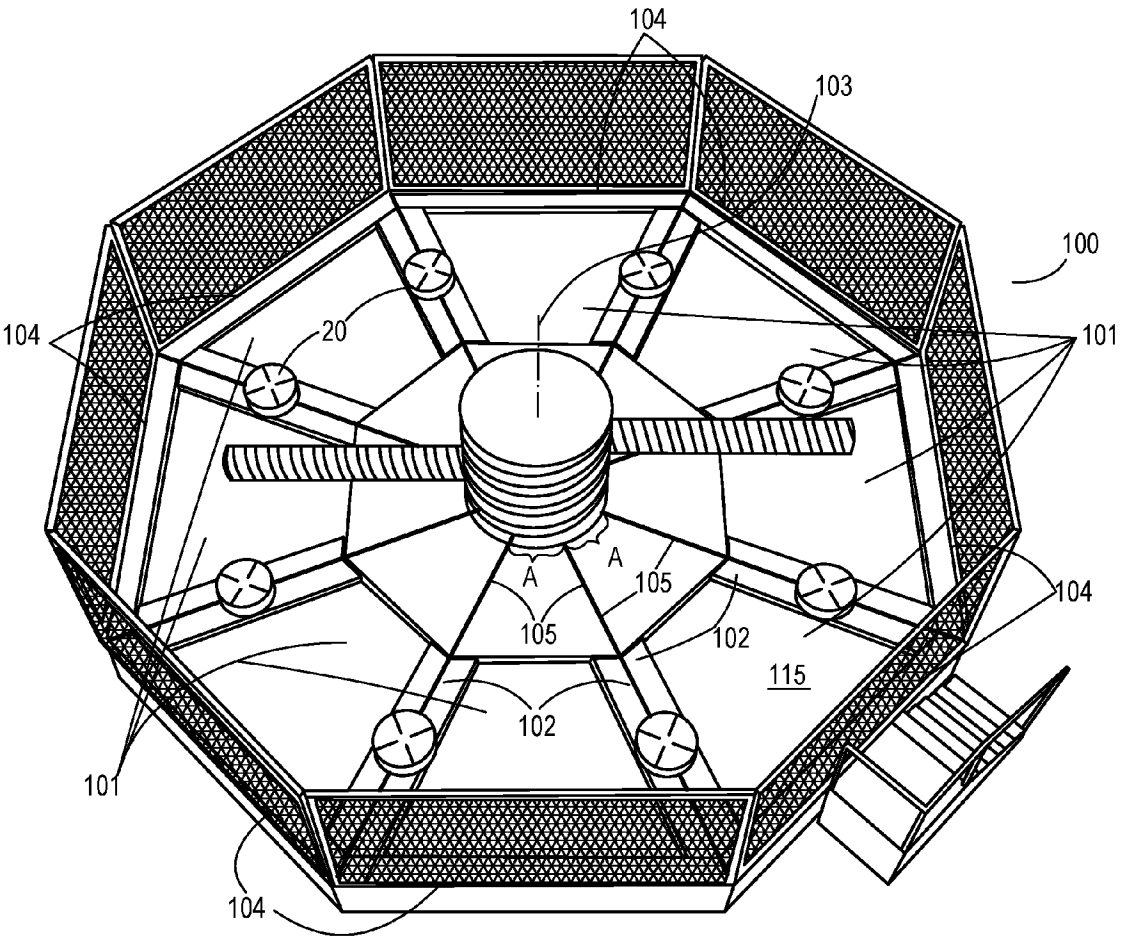
FIG. 1 is a perspective top view of an exemplary trampoline system of the present invention.
Figure 2:
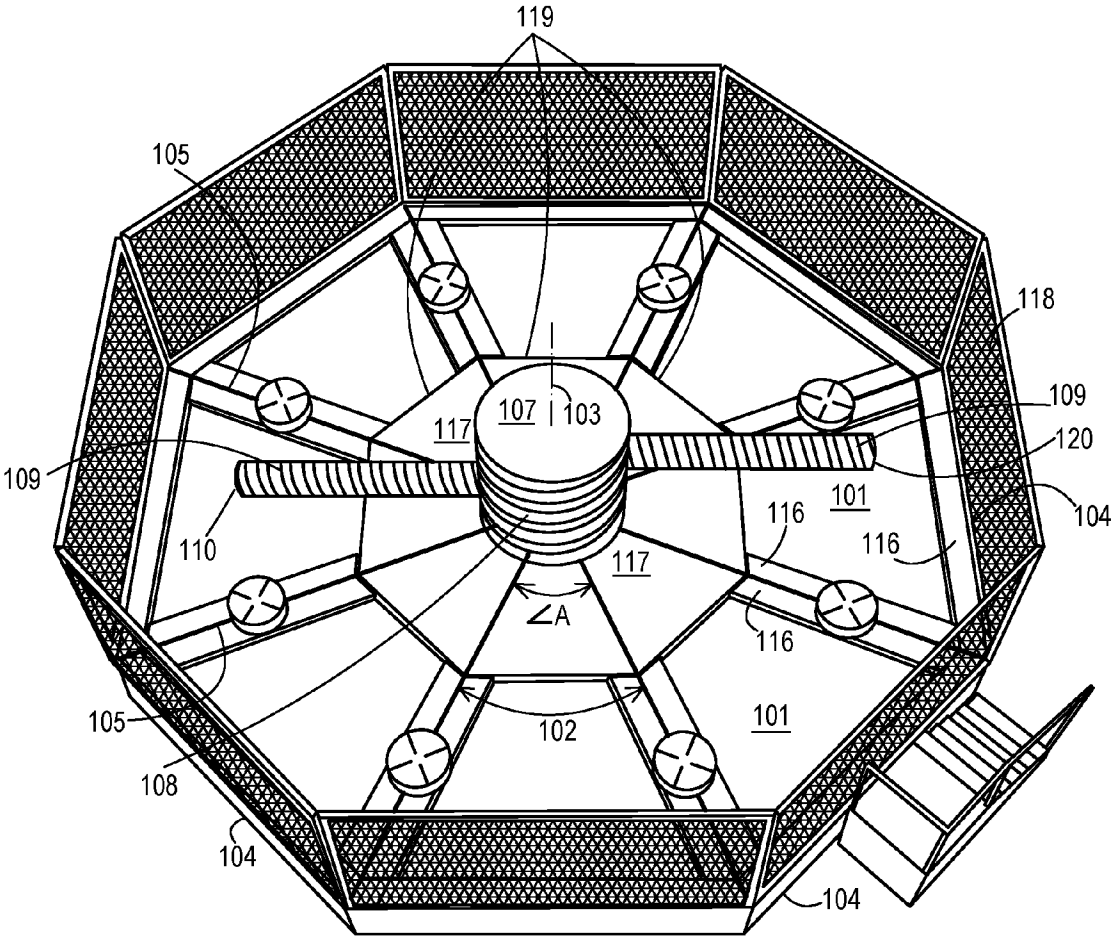
FIG. 2 is another perspective top view of an exemplary trampoline system of the present invention.
Figure 3:
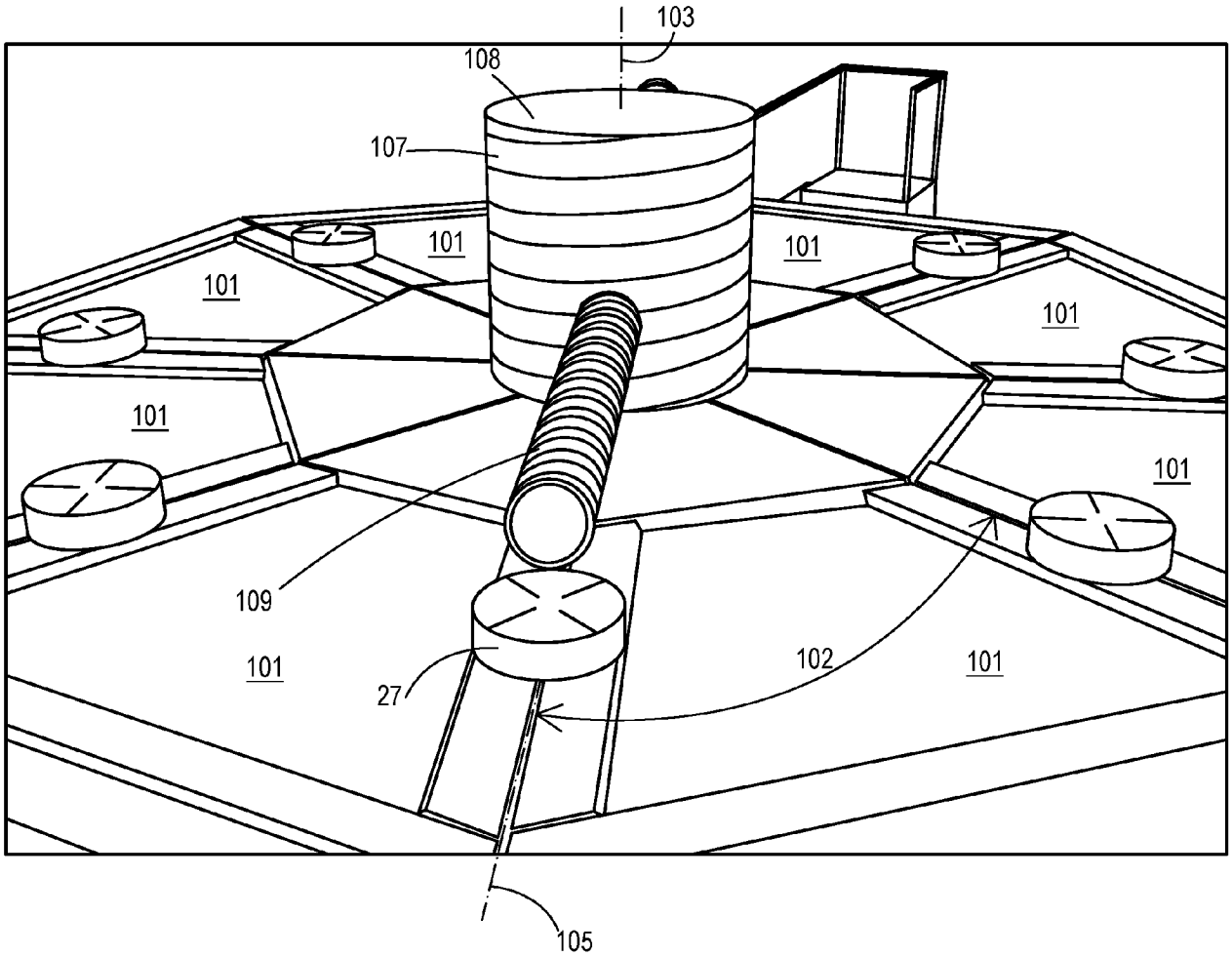
FIG. 3 is a closer perspective top view of the exemplary trampoline system shown in FIG. 2.
Figure 4:
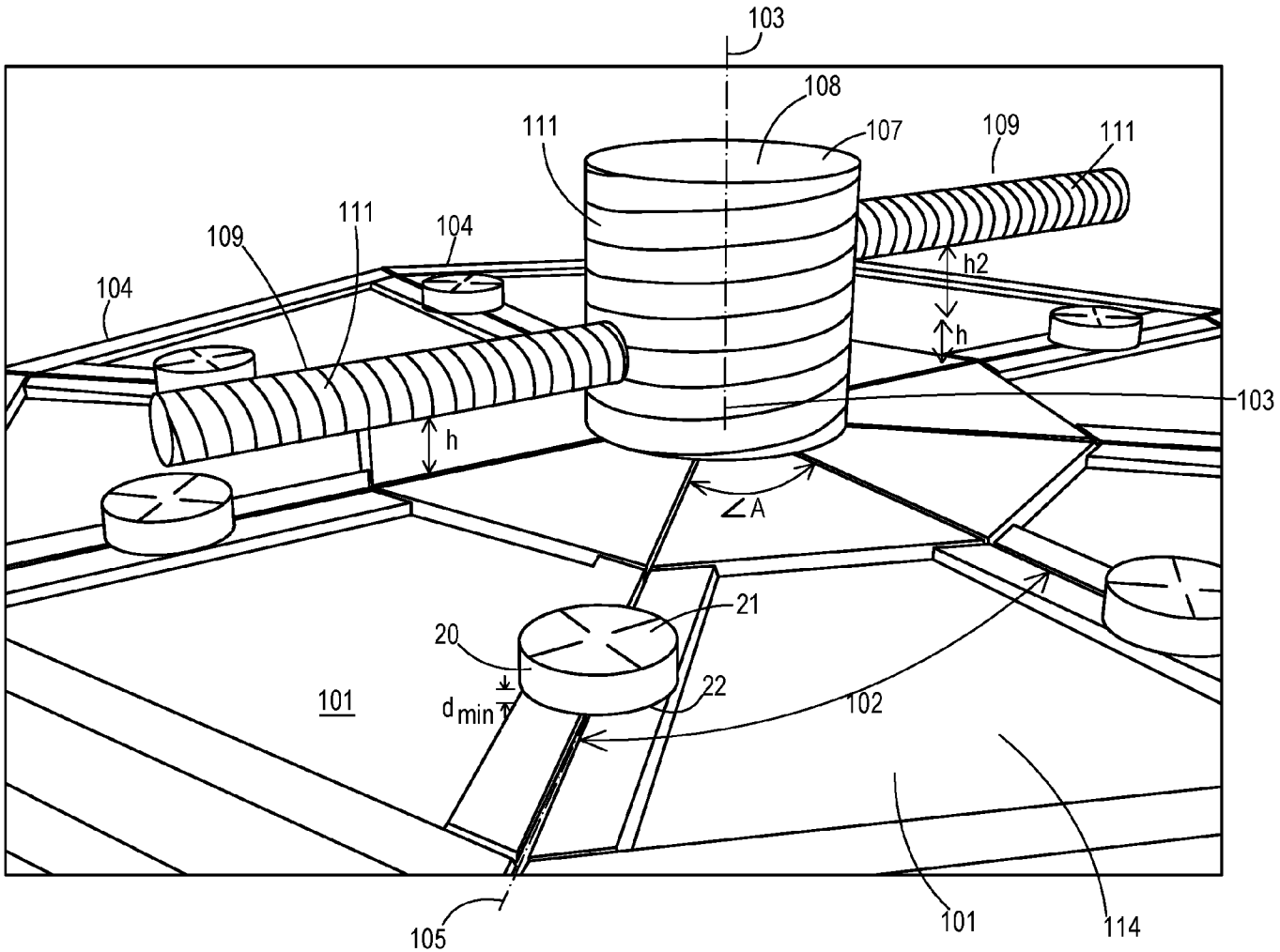
FIG. 4 is another closer perspective top view of the exemplary trampoline system shown in FIG. 2.
Figure 6:
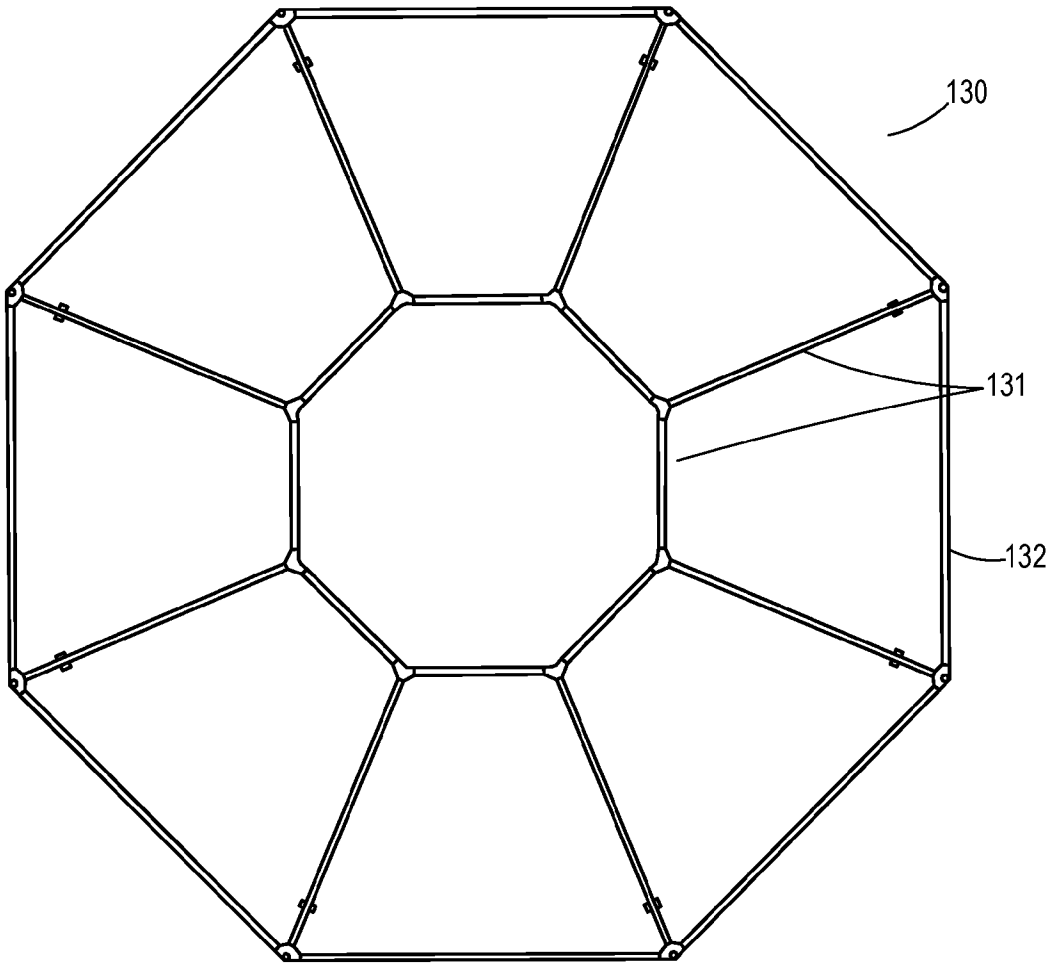
FIG. 6 is a top view of an exemplary frame suitable for supporting the exemplary trampoline system shown in FIGS. 1-5.

38. The trampoline system 100 of embodiment 37, wherein said one or more joints 121 comprises two or more joints 121 along a given horizontally-extending arm 109.
39. The trampoline system 100 of any one of embodiments 1 to 38, further comprising: one or more platforms 20 positioned over one or more opposite side surface edges 102 and one or more opposite lines 105, each platform 20 having an upper platform surface 21 and a lower platform surface 22, said lower platform surface 22 being positioned at least a minimum distance $d_{min}$ above an upper surface 114 of at least one of said four or more trampoline jumping surfaces 101. See, for example, FIG. 4.
40. The trampoline system 100 of embodiment 39, wherein said lower platform surface 22 extends over at least one of said at least one of said four or more trampoline jumping surfaces 101.
41. The trampoline system 100 of embodiment 39 or 40, wherein said lower platform surface 22 extends over two or more of said four or more trampoline jumping surfaces 101.
42. The trampoline system 100 of any one of embodiments 39 to 41, wherein a lower platform surface 22 of a single platform 20 extends over 2 adjacent trampoline jumping surfaces 101. See, for example, single circular-shaped platform 20 shown in FIG. 4.
43. The trampoline system 100 of any one of embodiments 1 to 42, further comprising: a trampoline support structure 130, said trampoline support structure 130 comprising a support structure frame member 131 (*i*) having an upper surface 132, and (ii) extending from proximate said outer edge 104 to a ground surface 133. See, for example, exemplary trampoline support structure 130 shown in FIGS. 6-8.
44. The trampoline system 100 of embodiment 43, wherein said lower platform surface 22 is positioned at least minimum distance $d_{min}$ above said upper surface 132 of said support structure frame member 131.
45. The trampoline system 100 of any one of embodiments 39 to 44, wherein minimum distance $d_{min}$ is equal to or greater than about 1.0 inch (in) (or any value, in increments of 0.1 in, greater than 1.0 in, e.g., 1.6 in, or any range of values, in increments of 0.1 in, greater than 1.0 in, e.g., from about 1.5 in to about 36.2 in).
46. The trampoline system 100 of any one of embodiments 39 to 45, wherein minimum distance $d_{min}$ is about 1.5 in to about 12.0 in.
47. The trampoline system 100 of any one of embodiments 39 to 46, wherein said upper platform surface 21 is positioned at least a maximum distance $d_{max}$ above upper surfaces 124 of said four or more trampoline jumping surfaces 101.
48. The trampoline system 100 of any one of embodiments 39 to 47, wherein said upper platform surface 22 is substantially parallel with said lower platform surface 21 (i.e., within parallel planes relative to one another).
49. The trampoline system 100 of any one of embodiments 39 to 47, wherein said upper platform surface 21 is not parallel with said lower platform surface 22 (i.e., not within parallel planes relative to one another).
50. The trampoline system 100 of any one of embodiments 39 to 46 or 49, wherein said upper platform surface 21 is at an angle B (not shown) relative to said lower platform surface 22, said angle B being less than about 45° (or any value, in increments of 0.1°, less than 45°, e.g., 4.2°, or any range of values, in increments of 0.1°, less than 45°, e.g., from about 0.8° to about 2.8°).
51. The trampoline system 100 of embodiment 50, wherein angle B ranges from about 5° to about 30°.
52. The trampoline system 100 of any one of embodiments 47 to 51, wherein maximum distance $d_{max}$ is equal to or less than about 72.0 in (or any value, in increments of 0.1 in, less than 72.0 in, e.g., 36.5 in, or any range of values, in increments of 0.1 in, less than 72.0 in, e.g., from about 12.3 in to about 36.2 in).
53. The trampoline system 100 of any one of embodiments 47 to 52, wherein maximum distance $d_{max}$ is about 3.0 in to about 36.0 in.
54. The trampoline system 100 of any one of embodiments 47 to 53, wherein said platform 20 further comprises one or more platform frame members (not shown) separating said lower platform surface 22 from said upper platform surface 21.
55. The trampoline system 100 of any one of embodiments 47 to 54, wherein said platform 20 further comprises one or more platform frame members (not shown) separating said lower platform surface 22 from said upper platform surface 21, said one or more platform frame members comprising one or more horizontally-extending platform frame members (not shown).
56. The trampoline system 100 of any one of embodiments 47 to 55, wherein said platform 20 further comprises one or more platform frame members (not shown) separating said lower platform surface 22 from said upper platform surface 21, said one or more platform frame members (not shown) comprising one or more vertically-extending platform frame members (not shown).
57. The trampoline system 100 of embodiment 56, wherein at least one of said one or more vertically-extending platform frame members (not shown) is positioned above at least one of said four or more trampoline jumping surfaces 101.
58. The trampoline system 100 of embodiment 56 or 57, wherein each of said one or more vertically-extending platform frame members (not shown) is positioned above at least one of said four or more trampoline jumping surfaces 101.
59. The trampoline system 100 of any one of embodiments 39 to 58, wherein at least one upper platform surface 21 has a circular shape. See, for example, exemplary platform 20 shown in FIGS. 1-5.
60. The trampoline system 100 of any one of embodiments 39 to 59, wherein at least one upper platform surface 21 has a rectangular shape.
61. The trampoline system 100 of any one of embodiments 39 to 60, wherein at least one upper platform surface 21 has a square shape.
62. The trampoline system 100 of any one of embodiments 39 to 61, wherein at least one upper platform surface 21 has an oval or diamond shape. It should be understood that the upper platform surface 21 may have any upper surface shape. Other possible upper surface shapes include, but are not limited to, a star shape, a triangular shape, a pentagon shape, a hexagon shape, an octagon shape, a figure-eight shape, and a rhombus shape.
63. The trampoline system 100 of any one of embodiments 39 to 62, wherein said one or more platforms 20 comprise from about 2 to about 20 platforms 20. As shown in FIG. 1, exemplary trampoline system 100 comprises eight separate platforms 20. It should be understood that a given trampoline system of the present invention may have any number of separate platforms 20.

64. The trampoline system 100 of any one of embodiments 1 to 63, wherein said trampoline system 100 comprising up to about 36 separate trampoline jumping surfaces 101.
65. The trampoline system 100 of any one of embodiments 1 to 64, wherein each of said four or more trampoline jumping surfaces 101 comprises a separate fabric material 115. See, for example, FIG. 1. Although any trampoline material may be used, each trampoline jumping surface 101 is typically an upper surface of a woven polypropylene trampoline fabric.
66. The trampoline system 100 of embodiment 65, wherein said trampoline system 100 further comprises a plurality of elastic members (not shown), said plurality of elastic members connecting said separate fabric material 115 to a support structure frame member 130 of said trampoline system 100.
67. The trampoline system 100 of embodiment 66, wherein said plurality of elastic members comprises a plurality of springs (not shown).
68. The trampoline system 100 of any one of embodiments 39 to 67, wherein said lower platform surface 22 is substantially planar to said four or more trampoline jumping surfaces 101 (i.e., within parallel planes relative to one another).
69. The trampoline system 100 of any one of embodiments 39 to 68, wherein said upper platform surface 21 has an upper surface area of at least 16 square inches ($in^2$) up to about 400 square feet ($ft^2$). Typically, a given platform 20 has an upper surface area that is proportional to an upper surface area of an adjacent trampoline jumping surface 101. For example, a trampoline jumping surface 101 having an overall length of 10 ft may have a platform 20 positioned adjacent thereto, wherein the platform 20 has an upper surface area ranging from about 1.0 $ft^2$ to about 30 $ft^2$. For a trampoline jumping surface 101 having an overall length of 130 ft, a platform 20 positioned adjacent thereto might have an upper surface area ranging from about 1.0 $ft^2$ to about 390 $ft^2$.
70. The trampoline system 100 of any one of embodiments 39 to 69, wherein said upper platform surface 21 has an upper surface area of from about 1.0 $ft^2$ to about 12.0 $ft^2$.
71. The trampoline system 100 of any one of embodiments 39 to 70, wherein no portion of said one or more platforms 20 comes into contact with said four or more trampoline jumping surfaces 101.
72. The trampoline system 100 of any one of embodiments 39 to 71, wherein at least a portion of each of said one or more platforms 20 extends over at least some springs (not shown) used to fasten said four or more trampoline jumping surfaces 101 to a trampoline support structure 130.
73. The trampoline system 100 of any one of embodiments 39 to 72, wherein at least a portion of each of said one or more platforms 20 is covered with padding material.
74. The trampoline system 100 of any one of embodiments 39 to 73, wherein at least a portion of each of said one or more platforms 20 is covered with padding material comprising foam material. For example, the foam material may have a thickness of from about 1.0 in to about 5.0 in, more typically, from about 1.5 in to about 3.0 in.
75. The trampoline system 100 of any one of embodiments 39 to 74, wherein at least a portion of each of said one or more platforms 20 is covered with plywood.
76. The trampoline system 100 of any one of embodiments 39 to 75, wherein at least a portion of each of said one or more platforms 20 is covered with fabric material.
77. The trampoline system 100 of any one of embodiments 39 to 76, wherein at least a portion of each of said one or more platforms 20 is covered with polyvinyl chloride (PVC) fabric material.
78. The trampoline system 100 of any one of embodiments 1 to 77, further comprising first padding 116 extending over springs (not shown) used to fasten said four or more trampoline jumping surfaces 101 to a trampoline support structure 130/131.
79. The trampoline system 100 of any one of embodiments 1 to 78, further comprising second padding 117 extending outwardly from said central axis 103 towards said outer edge 104.
80. The trampoline system 100 of any one of embodiments 1 to 79, further comprising a safety wall or net 118 extending upward from and along said outer edge 104.
81. The trampoline system 100 of any one of embodiments 1 to 80, wherein said trampoline system 100 has an overall shape having up to about eight side edges extending along said outer edge 104. It should be understood that trampoline system 100 may have any overall shape. Possible overall shapes include, but are not limited to, a circular shape, a star shape, a triangular shape, a square shape, a pentagonal shape, a hexagonal shape, an octagonal shape, a figure-eight shape, and a rhombus shape.
82. The trampoline system 100 of any one of embodiments 1 to 81, wherein said trampoline system 100 has an overall octagonal shape.

Methods of Making Trampoline Systems

83. A method of making the trampoline system 100 of any one of embodiments 1 to 82, said method comprising: assembling the four or more (or two or more) trampoline jumping surfaces 101 with one another so that all opposite side surface edges 102 extend along opposite lines 105.
84. The method of embodiment 83, further comprising: attaching the four or more trampoline jumping surfaces 101 to a trampoline support structure 130.
85. The method of embodiment 83 or 84, further comprising: positioning a rotating member 107 along the central axis 103, the rotating member 107 comprising a vertically-extending member 108, and at least one horizontally-extending arm 109 extending outward from the vertically-extending member 108 towards the outer edge 104. See, for example, exemplary rotating member 107 shown in FIGS. 1-5.
86. The method of any one of embodiments 83 to 85, further comprising: positioning one or more platforms 20 over one or more opposite side surface edges 102 and one or more opposite lines 105, each platform 20 having an upper platform surface 21 and a lower platform surface 22, the lower platform surface 22 being positioned at least a minimum distance $d_{min}$ above an upper surface 114 of at least one of the four or more trampoline jumping surfaces 101. See, for example, FIG. 4.
87. The method of embodiment 86, further comprising: attaching a padded surface member (not shown) onto an upper portion of one or more platform frame members (not shown) so as to form the upper platform surface 21.
88. The method of embodiment 86 or 87, further comprising: covering one or more outer side surfaces 27 of one or more platform frame members (not shown) with at least one padded surface member (not shown).
89. The method of any one of embodiments 86 to 88, further comprising: positioning at least one padded surface member (not shown) between the lower platform surface 22 and at least one of the four or more trampoline jumping surfaces 101.

90. The method of any one of embodiments 86 to 89, further comprising: covering one or more outer surfaces 27 of one or more platform frame members (not shown) with plywood.
91. The method of any one of embodiments 86 to 90, further comprising: covering one or more outer surfaces 27 of one or more platform frame members (not shown) with fabric material.
92. The method of any one of embodiments 86 to 91, further comprising: covering one or more outer surfaces 27 of one or more platform frame members (not shown) with fabric material comprising polyvinyl chloride (PVC) fabric material.
93. The method of any one of embodiments 83 to 92, further comprising: covering springs (not shown) used to fasten the four or more trampoline jumping surfaces 101 to a trampoline support structure 130 with first padding 116.
94. The method of any one of embodiments 83 to 93, further comprising: covering an area extending outwardly from said central axis 103 towards said outer edge 104 with second padding 117.
95. The method of any one of embodiments 83 to 94, further comprising: assembling a safety wall or net 118 that extends upward from and along the outer edge 104.
96. The method of any one of embodiments 83 to 94, further comprising: incorporating one or more joints 121 along a length La of the at least one horizontally-extending arm 109.
97. The method of embodiment 96, wherein the one or more joints 121 are incorporated (i) between a given horizontally-extending arm 109 and vertically-extending member 108, such as exemplary joint 121*a*, or (ii) between proximate and distal sections, 122/123 respectively, of a given horizontally-extending arm 109, such as exemplary joint 121*b*, or both (i) and (ii).

Methods of Using Trampoline Systems

98. A method of using the trampoline system 100 of any one of embodiments 1 to 82, said method comprising: jumping on at least one of the four or more trampoline jumping surfaces 101.
99. The method of embodiment 98, further comprising: trying to avoid contact with the at least one horizontally-extending arm 109 of the rotating member 107 rotating along central axis 103.

It should be understood that although the above-described trampoline systems, and methods are described as "comprising" one or more components or steps, the above-described trampoline systems, and methods may "comprise," "consists of," or "consist essentially of" any of the above-described components or steps of the trampoline systems, and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a trampoline system and/or method that "comprises" a list of elements (e.g., components or steps) is not necessarily limited to only those elements (or components or steps), but may include other elements (or components or steps) not expressly listed or inherent to the trampoline system and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a protective trampoline system and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described trampoline systems and/or methods may comprise, consist essentially of, or consist of any of the herein-described components and features, as shown in the figures with or without any feature(s) not shown in the figures. In other words, in some embodiments, the trampoline systems and/or methods of the present invention do not have any additional features other than those shown in the figures, and such additional features, not shown in the figures, are specifically excluded from the trampoline systems and/or methods. In other embodiments, the trampoline systems and/or methods of the present invention do have one or more additional features that are not shown in the figures.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Trampoline systems, similar to exemplary trampoline system 100 shown in FIGS. 1-8, were prepared.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A trampoline system comprising:

four or more trampoline jumping surfaces;

a central axis defined at an inner connecting point of the trampoline jumping surfaces;

an outer edge defined by the periphery of the trampoline jumping surfaces when arranged with the central axis at an inner connecting point; and a rotating member having a vertically-extending member and a horizontally extending arm extending from the vertically-extending member towards the outer edge, wherein the rotating member is configured to rotate along the central axis, wherein each of the trampoline jumping surfaces extends between the central axis and an the outer edge, wherein the outer edge completely surrounds the central axis.

2. The trampoline system of claim 1, wherein the trampoline system comprises eight trampoline jumping surfaces.

3. The trampoline system of claim 1, wherein each trampoline jumping surface has a triangular shape.

4. The trampoline system of claim 1, wherein each of the trampoline jumping surface has a trapezoid shape.

5. The trampoline system of claim 1, wherein the rotating member further comprises a second horizontally extending arm positioned on an opposite sides of the vertically-extending member from the first horizontally extending arm.

6. The trampoline system of claim 5, wherein the two horizontally extending arms rotate at different heights above the trampoline jumping surfaces.

7. The trampoline system of claim 5, wherein the rotating member further comprises a third horizontally extending arm positioned on an opposite sides of the vertically-extending member from the first and second horizontally extending arm.

8. The trampoline system of claim 7, wherein the three horizontally extending arms rotate at different heights above the trampoline jumping surfaces.

9. The trampoline system of claim 1, wherein the a horizontally extending arm comprises is configured to allow the horizontally extending arm to bend upward, downward, sideways, or any combination of upward, downward, and sideways, when a force is applied to the horizontally extending arm.

10. The trampoline system of claim 9, wherein the horizontally extending arm comprises a flexible material.

11. The trampoline system of embodiment 9, wherein the horizontally extending arm comprises:

a rigid material; and a joint positioned along the length of the horizontally extending arm.

12. The trampoline system of claim 1, wherein the rotating member rotates about the central axis at a frequency of up to about 60 rotations per minute.

13. The trampoline system of claim 1, further comprising:

a platform positioned over an outer edge of the trampoline jumping surfaces and having an upper platform surface and a lower platform surface.

14. The trampoline system of claim 1, further comprising a trampoline support structure having a support structure frame member extending from proximate the outer edge to a ground surface.

* * * * *